United States Patent [19]

Williams

[11] Patent Number: 5,018,589

[45] Date of Patent: May 28, 1991

[54] PROCESS FOR FINDING THE DEPTH OF A LOST RETURN ZONE

[76] Inventor: James M. Williams, 404 Academy St., Houma, La. 70360

[21] Appl. No.: 387,138

[22] Filed: Jul. 31, 1989

Related U.S. Application Data

[63] Continuation-in-part of Ser. No. 301,624, Jan. 25, 1989, Pat. No. 4,919,218.

[51] Int. Cl.[5] ..... E21B 47/10

[52] U.S. Cl. ..... 175/72; 175/48; 73/155

[58] Field of Search ..... 175/72, 57, 65, 40, 175/48; 166/254, 274; 73/155

[56] References Cited

U.S. PATENT DOCUMENTS

| | | | |
|---|---|---|---|
| 3,955,411 | 5/1976 | Lawson, Jr. | 73/155 |
| 4,346,594 | 8/1982 | Owings | 73/155 |
| 4,610,161 | 9/1986 | Gehrig et al. | 175/48 |

*Primary Examiner*—Ramon S. Britts
*Assistant Examiner*—Terry Lee Melius

[57] ABSTRACT

In a process of downhole drilling in an open hole, where the drill bit has struck a lost circulation zone in the wall of the formation, and mud circulating through the annulus during drilling has been lost into the zone and therefore circulation of the mud has been lost, the process for locating the depth of the lost return zone would include the steps of (a) detecting a drop in the mud level within the annulus of the drill casing to a central depth; (b) introducing a quantity of lighter fluid such as 8.5 pound salt water into the annulus of the borehole so that the annulus becomes filled with the lighter fluid; (c) closing off any flow of fluid out of the annulus substantially at the level of the earth's surface; (d) pushing a quantity of the mud in the annulus into the formation by the weight of the lighter fluid flowing into the annulus; from the distance that the mud fell in the annulus, calculating the height that the mud did not drop in the annulus in order to have the same hydrostatic head of the lost return zone depth; following the establishing of the hydrostatic head, reading the gauge pressure of 5.45 pounds for every barrel pumped into the lost return zone; and multiplying the number of barrels required to get the hydrostatic multiplied by 5.425 divided by 0.052 and divided by 0.15 (fracking weight) will equal the depth of the lost return zone.

6 Claims, 3 Drawing Sheets

PROCESS FOR FINDING THE DEPTH OF A LOST RETURN ZONE

This is a continuation-in-part of application entitled "Process For Reestablishing Circulation In A Lost Return Zone", bearing U.S. Ser. No. 07/301,624, Filed Jan. 25, 1989, by the same inventor, now U.S. Pat. No. 4,919,218.

BACKGROUND OF THE INVENTION

1. Field of the Invention

The present invention relates to a process for locating the depth downhole of a lost return zone. The location of the depth down an open borehole, where the surrounding strata has collapsed, and is created what is referred to as a lost return zone.

2. General Background

In the drilling of oil wells, the manner in which the drill bit is maintained relatively cool, and the cuttings from the bit are returned to the surface is very important. In the present state of the art, as the bit is drilling through the strata downhole, a particular weight mud, either water base or oil base, is circulated down through the drill string through the drill bit, wherein the mud picks up the cuttings from the bit, and is recirculated back to the surface in the annular space between the outer wall of the drill string and the wall of the formation that the bit is drilling through. The column of mud, in accomplishing this constant circulation down through the string and up through the annulus, also serves to protect against the inadvertent striking of a pocket of pressurized hydrocarbons, and to maintain the hydrostatic head on the formation so that the well would not blow out in the event that such a pocket were struck by the drill bit.

However, one problem which is confronted in open hole drilling, is the fact that often times the drill bit will run through a zone of formation which is called a "no circulation zone", where the wall of the formation would collapse, and allow the mud in the annulus to flow into the formation, and into the lost circulation zone. Through experience, it has been found when such lost circulation occurs, there are few remedies that can be achieved in order to regain circulation. If, for example, one knows of the depth of the lost circulation zone, it may be possible to send materials down the annulus to that particular depth, in order to "plug" the hole in the formation, and maintain the drilling process. Otherwise, often times it is necessary that this particular wall of the annulus has to be cemented so as to provide the necessary wall that will not allow further loss of mud so that recirculation of the mud can be obtained. However, if one is unable to determine the depth of the lost circulation zone, then there is virtually no way that recirculation of the mud can be obtained, and often times the hole must be cemented up and redrilled at a considerable loss in time and money.

Therefore, there is a need for one having the ability to calculate the depth of the lost circulation zone, so that the zone may be plugged or unnecessary work done on the wall of the annulus in order to restructure the wall so that mud can be circulated through the drill pipe and up to the annulus.

SUMMARY OF THE PRESENT INVENTION

In a process of downhole drilling in an open hole, where the drill bit has drilled through a lost circulation zone in the wall of the formation, and mud circulating through the annulus during drilling has been lost into the zone and therefore circulation of the mud has been lost, the process for locating the depth of the lost return zone would include the steps of (a) detecting a drop in the mud level within the annulus of the drill casing to a certain depth; (b) introducing a quantity of lighter fluid such as salt water into the annulus of the borehole so that the annulus becomes filled with the lighter fluid; (c) closing off any flow of fluid out of the annulus substantially at the level of the earth's surface; (d) pushing a quantity of the mud in the annulus into the formation by the weight of the lighter fluid flowing into the annulus; from the distance that the mud fell in the annulus, calculating the height that the mud did not drop in the annulus in order to have the same hydrostatic head of the lost return zone depth; following the establishing of the hydrostatic head, reading the gauge pressure of 5.425 pounds for every barrel pumped into the lost return zone; and multiplying the number of barrels required to get the hydrostatic multiplied by 5.425 divided by 0.052 divided by 0.15 (Equivalent Fracking Weight) will equal the depth of the lost return zone.

The constant 0.052 is used in finding the hydrostatic head of any fluid weight at any given depth. For example, $0.052 \times 16.0$ pound mud $\times$ 13,000 feet = 10,816 hydrostatic head.

The constant 0.15 is used in finding the hydrostatic head pressure that it takes for fluid to frack into the formation that has the same hydrostatic head due to the frictional force opposing fluid flow into the formation.

Therefore it is a principal object of the present invention to provide a process to locate the depth of a lost circulation zone in an open borehole;

It is still a further object of the present invention to provide a process for locating the lost return zone while drilling in an open borehole by introducing a lighter fluid into the borehole to push the heavier mud into the formation, establishing a hydrostatic head and calculating the amount of fluid over the presumed amount in order to find the depth of the borehole; and It is still a further object of the present invention to provide a process for establishing the depth of a lost return zone in an open borehole by closing off the hydril and pushing the heavier mud into the formation for establishing a proper hydrostatic head so that the gauge readings may in turn enable one to calculate the depth of the hole.

These and other objects of this invention will be readily apparent to those skilled in the art from the detailed description and claims which follow.

BRIEF DESCRIPTION OF THE DRAWINGS

For a further understanding of the nature and objects of the present invention, reference should be had to the following detailed description, taken in conjunction with the accompanying drawings, in which like parts are given like numerals, and wherein.

DETAILED DESCRIPTION OF THE PREFERRED EMBODIMENT

Figure 1:
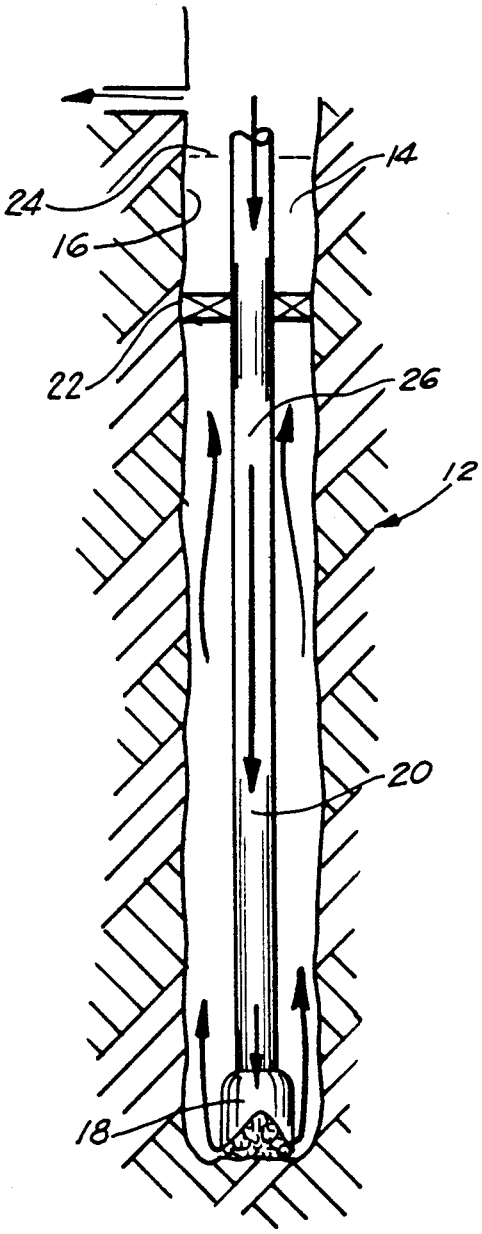
FIG. 1 illustrates a cross-section of a typical open borehole that is being drilled via a drill bit at the end of a drill string.

As illustrated in the FIGURES, the process of the present invention would relate to typical borehole as illustrated in FIG. 1, wherein there is included a borehole 12, having a diameter 14, the borehole 12 being a "open hole", that is where casing is no longer lining the walls 16 of the borehole 12, and the only support for the walls 16 of the borehole 12 is the formation itself. In this particular drilling process, a borehole at this depth is being drilled by a drill bit 18, at the end of a drill string 20, which emanates from the ground above. As illustrated in FIG. 1, there is further included an apparatus for closing off the flow of fluid from the borehole, this apparatus known in the art as a hydril 22, as seen in FIG. 1. In FIG. 1, in the normal process, a column of mud 24 is contained within the borehole, in a dynamic state, in order to provide a hydrostatic head against the formation and the point of the drill bit, so as to prevent any advertent blowout should the bit strike a pocket of hydrocarbons. The weight of the mud is usually calculated so as to provide the necessary hydrostatic head, yet allow circulation of the mud down through the internal bore 26 of the drill string in order to lubricate the bit, and up to the annulus between the wall of the borehole and and the outer wall of the drill string in order to return the cuttings made by the bit up to the surface that can be filtered out so that mud can be returned down the hole. As was stated earlier, this circulation of mud through the borehole during drilling is a dynamic system, and is a very well balanced system in terms of weight.

Figure 2:
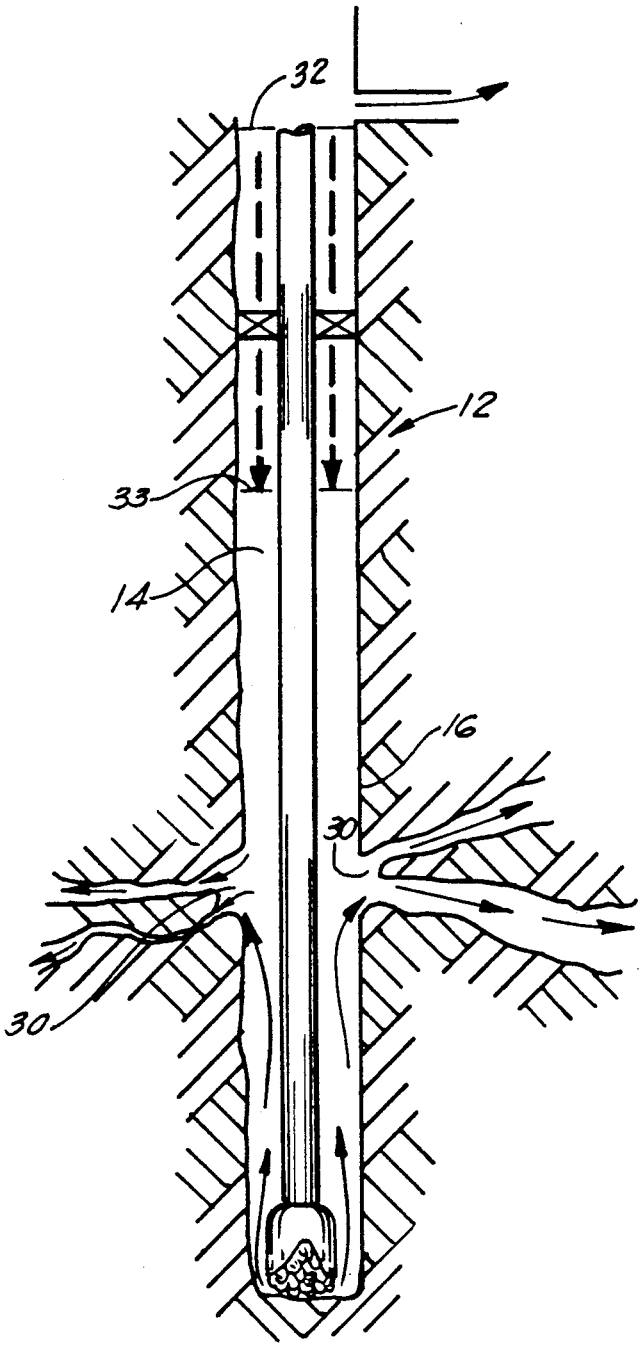
FIG. 2 illustrates in cross-section a borehole being drilled by a drill bit at the end of a drill string, wherein there is further illustrated a formation of a lost return zone down the borehole.
Figure 3:
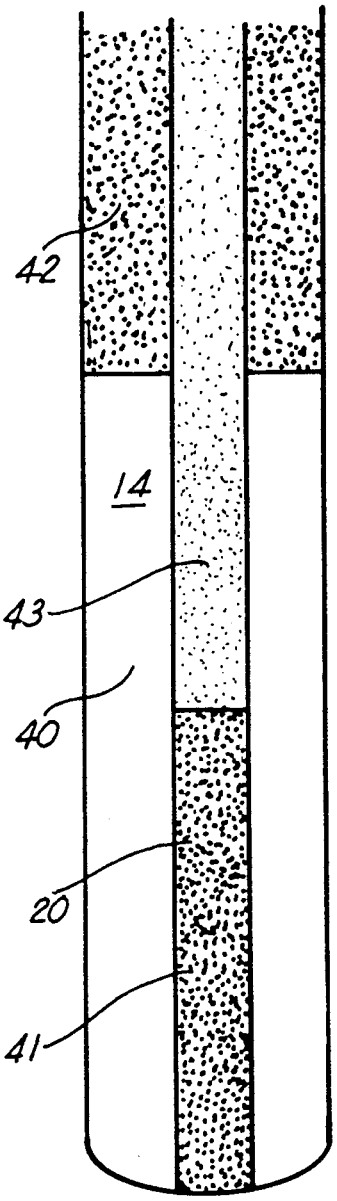
FIGS. 3–8 illustrate a representational cross-section view of the borehole and the steps in replacing the heavier mud in the borehole with lighter mud so as to reestablish circulation in the hole.
Figure 4:
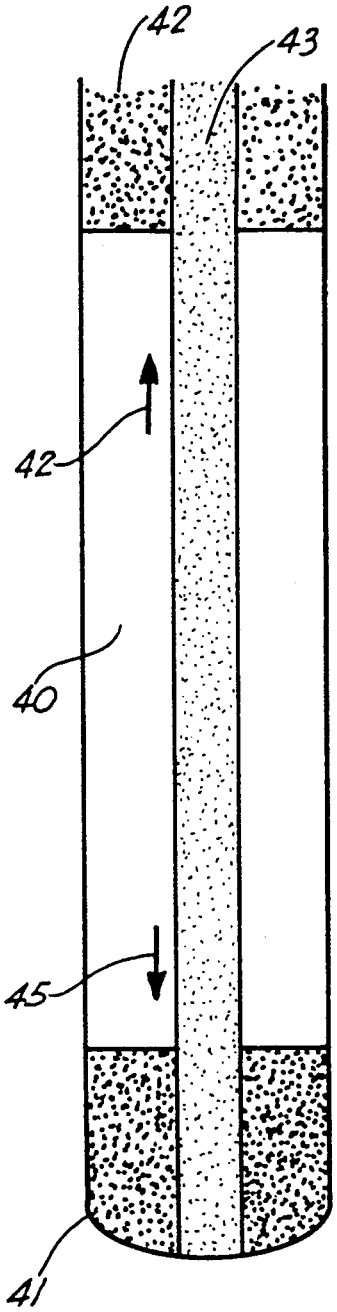
Figure 5:
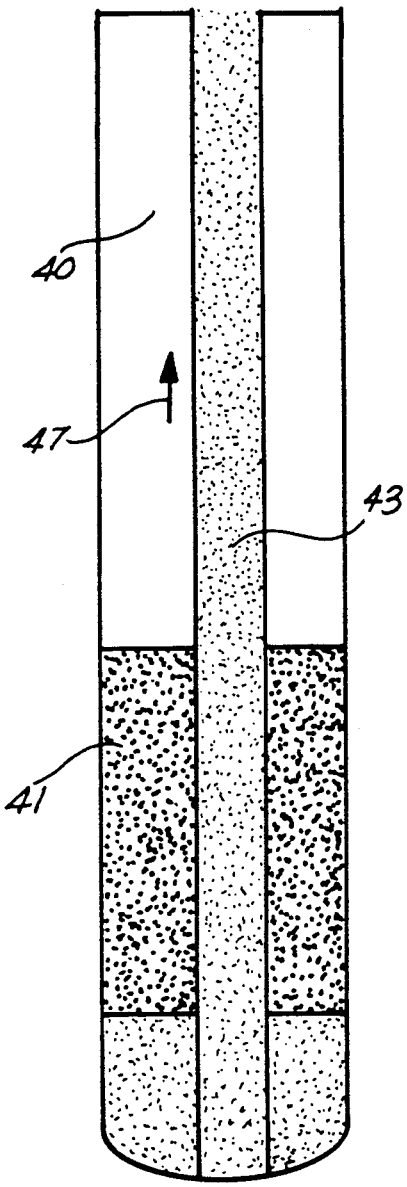
Figure 6:
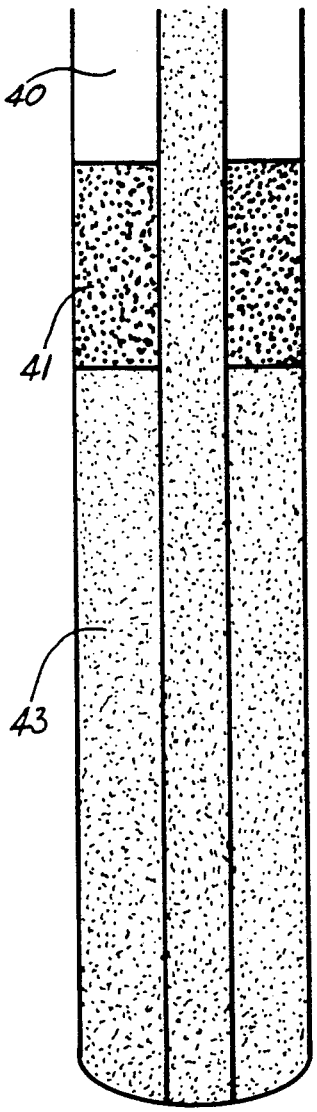
Figure 7:
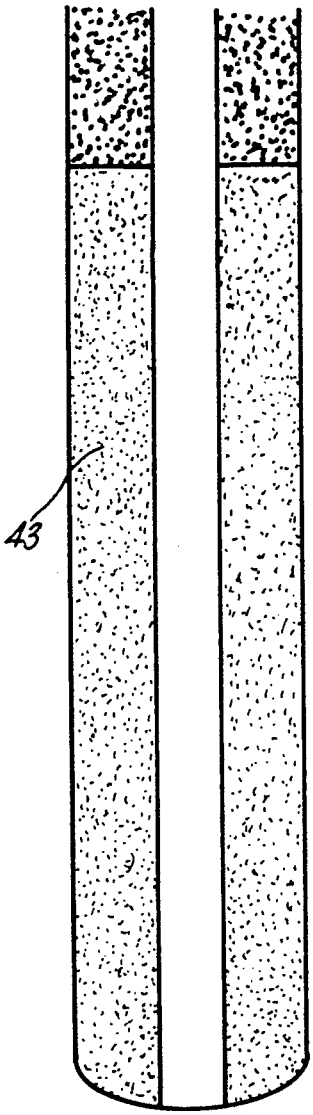
Figure 8:
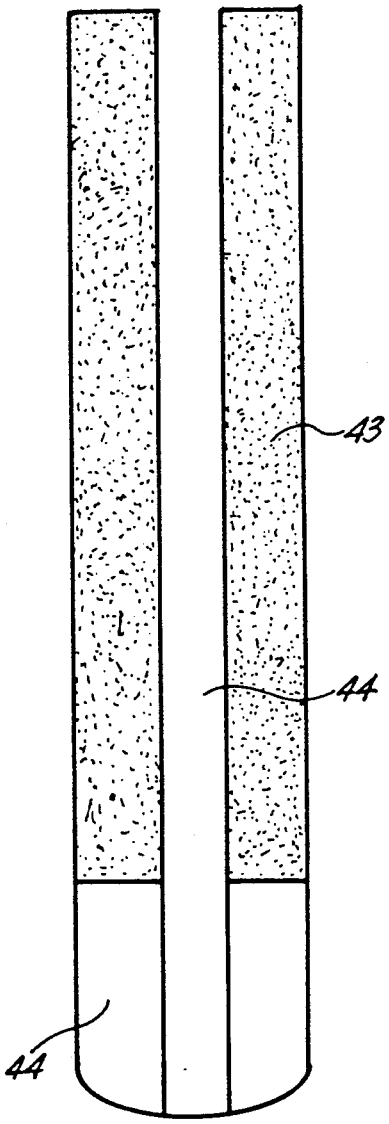

In FIG. 2, there is illustrated a problem which often arises in an open hole, during drilling, which is known as hitting a loss return zone. As illustrated in FIG. 2, again there is a typical borehole 12, however in this particular instance, a portion of the wall 16 of the open hole 14, has eroded at a lost return zone 30, and the mud which would normally fill the annulus between the drill string and the wall of the borehole has flowed into the formation at lost return zone 30, and therefore the level of mud which is normally at the return line 32 at the top of the hole has dropped a certain level 33 within the hole. Under this condition, when mud has entered a lost return zone, the mud will not circulate up back through the borehole, and one has completely lost all returns. Therefore, the drilling process must cease, and in most instances the hole must be cemented and redrilled.

In the present state of the art, when there is mud lost in the borehole due to the creation of a lost return zone downhole, conventional wisdom is that the depth of the lost return zone is the amount of fluid that it would take to fill up the borehole down to the level that the loss of mud is shown. That is, by example, if the level of the mud drops from the level of the earth down 450 feet, the conventional wisdom was that the lost return zone was in the neighborhood of total depth of hole. However, it has been found that this is not so.

The process of the present invention, the following steps are necessary in order to calculate the depth of the lost return zone. It has been found that one can have the same lost in hydrostatic head, and the mud will drop the same or it can be at any depth in the hole. Therefore, the pertinent fact is that one must establish not how far it could fall, but how far it did not fall because of it having to frack into the formation, and the friction of it flowing into that lost circulation zone. So the starting point for calculating the lost return zone is calculating the depth at which the mud should have fallen but did not fall.

In effect, when mud is lost to a lost return zone, and the mud level drops in the annulus, due to the mud flowing into the formation, the mud cannot fall far enough in order to establish a true U-tube effect because of the friction of the mud and the annulus equivalent circulating density of the mud drop, i.e., E.C.D. Every depth will have a different ECD or height of the mud that could not flow into the U-tube on account of the amount of friction in the borehole. In the process of the present invention, one would undertake the following steps:

(a) one would establish that there has been a loss by a drop of the mud level of the borehole to a certain depth;

(b) one would then pump a lighter fluid such as 8.5 weight salt water into the borehole and calculate the amount of barrels of salt water that it took in order to fill the borehole; and (c) next, the borehole will be sealed off for the use of for example, the hydril, so that as additional fluid was pumped into the borehole, fluid could not flow upward through the open borehole.

Next, following the closing off of the hydril, one would then calculate the amount of fluid that it would take in order to create a true U-tube effect between the fluid in the borehole and the formation and calculate the amount that the mud did not fall due to friction and other factors.

For example, at a depth of 13,000 TVD with the 16 pound mud in the hole, and one would witness that the mud level dropped to 323 feet down in the annulus. By calculating 323 feet $\times$ the constant of $0.052 \times 16.0$ pound mud would give you the loss in the hydrostatic head of 269 pounds. If you took 49.6 barrels of 8.5 pound saltwater to fill the annulus, then one can obtain the number of pounds per barrel by multiplying one barrel $\times 13.91$ linear feet per barrel $\times 0.052 \times 7.5$ pound difference between the weight of the 16 pound mud and the 8.5 pound saltwater to give the FIGURE of 5.425 pounds per barrel. Therefore, 49.6 barrels $\times 5.425$ pounds per barrel $= 269$ pounds in the hydrostatic head loss.

Next, with the annulus full, knowing that there is a 269 pound hydrostatic loss, one would close the hydril and take the leak-off test of 0.3 pounds at total depth with 8.5 pounds saltwater to find the lost return zone depth and the maximum weight the weakest formation will hold. Therefore, 0.3 pounds $\times$ the constant $0.052 \times 13{,}000$ TVD $= 203$ pounds of pressure. 203 pounds $\div 0.052 \div 7.5$ pounds (difference between 16 pound and 8.5 saltwater), equals 520 feet of 8.5 pound saltwater.

Next, 520 feet of 8.5 pound saltwater $\div 13.91$ linear feet pound barrel $= 37.4$ barrels of saltwater. Therefore, one must pump down the annulus with the hydril closed 37.4 barrels of saltwater if the pressure is to increase to 203 pounds above the slow pump rated rate. Pumping would be maintained until there is 203 pounds above the SPM pressure and the pump would be stopped. The 203 pounds of pressure is to find the height of the 16 pound mud that did not fall. The amount of barrels of 8.5 pound salt water pumped over the 37.5 barrels of saltwater is the difference in the mud height that could not fall far enough down the annulus in order to give a true U-tube effect. From the barrels pumped over 37.4 barrels of saltwater to get the 203 pounds is the depth of the lost return zone.

Therefore, if it took 51 barrels of 8.5 salt water to get 203 pounds on the pressure gauge, then 51 barrels minus 37.4 barrels (203 pounds) = 13.6 barrels to calculate into the hydrostatic head.

Next, 13.6 barrels ×5.425=74 pounds lost in the hydrostatic head. 74 pound lost ÷0.52 ÷16 pound mud =0.89 feet of mud that did not fall for the true U-tube effect with the formation depth that broke down. Therefore, 269 pound loss +74 pound loss equals 343 pounds total hydrostatic loss at the depth of the lost return zone. In order to calculate the actual depth, therefore one would multiply 13.6 barrels (the amount over the 37.4 barrels in order to reach the hydrostatic head of 203 pounds) ×5.425 (pounds per barrel) ÷0.052 (k constant) ÷0.15 pounds (fracking weight) equals 9459 feet as the depth of the lost return zone. Therefore, 342 pounds total hydrostatic head loss divided by 0.052 ÷9459 feet equals 0.7 pound mud weight loss at the depth of the lost return zone. Therefore, 323 pound loss ÷0.052 ÷16 pound mud =412 feet of mud should have dropped in the annulus to have the same hydrostatic head with the depth of the weakest formation. 412 feet total minus 323 feet dropped =89 feet is the height of the mud in the annulus that did not fall. Therefore, the lost return zone cannot be at any other depth. If it were, there would have been a different mud level dropped when annulus return were lost. The height of mud that could not fall to give the same hydrostatic head of depth of the weakest formation that broke down would also have been different.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A process for finding the depth of a lost return zone in an open bore hole, where the surrounding strata of the bore hole has collapsed, the process comprising the following steps:

(a) detecting a drop in the mud level within the annulus of the drill casing to a certain depth for establishing a lost return zone;

(b) introducing a quantity of a lighter fluid into the annulus of the bore hole so that the annulus becomes filled with the lighter fluid;

(c) closing off any flow of fluid out of the annulus substantially at the level of the earth's surface;

(d) pushing a quantity of the mud in the annulus into the eroded strata by the weight of the lighter fluid flowing into the annulus;

(e) determining the depth of the hole;

(f) determining the amount of lighter fluid introduced into the annulus;

(g) calculating the hydrostatic head loss; and (h) calculating the height that the mud in the annulus did not drop in order to establish the same hydrostatic head of the lost return zone depth, and calculating from that depth the depth of the lost return zone.

2. The process in claim 1, wherein there is further included the step of packing off the lost return zone after the depth has been established.

3. The process in claim 1, wherein the lighter weight fluid is saltwater.

4. The process in claim 1, wherein the flow of mud out of the annulus is closed off by closing off of the hydril.

5. The process in claim 3, further comprising the step of reading the gauge pressure of 5.425 pounds for every barrel of saltwater pumped into the annulus.

6. A process for establishing the depth of a lost return zone in an open bore hole, of the type which is created by the collapse of the wall of the bore hole, the process comprising the following steps:

(a) detecting a drop in the mud level within the annulus of the drill casing to reflect the creation of a lost return zone;

(b) introducing a quantity of saltwater into the annulus of the bore hole so that the annulus becomes filled with the saltwater;

(c) closing off any flow of fluid out of the annulus with the closing of the hydril, substantially at the level of the earth's surface;

(d) forcing a quantity of the mud in the annulus into the formation by the weight of the saltwater flowing into the annulus;

(e) determining the depth of the hole;

(f) determining the amount of saltwater introduced into the annulus;

(g) calculating the hydrostatic head loss;

(h) calculating the height that the mud did not drop, as a factor of the distance that the mud fell in the annulus, in order to establish the hydrostatic head of the lost return zone depth; and (i) multiplying the number of barrels of mud required to establish the hydrostatic head by 5.425, divided by 0.052 and divided by 0.15 (the equivalent fracking weight) to find the depth of the lost return zone.

* * * * *